US008204428B2

(12) United States Patent
Hattori

(10) Patent No.: US 8,204,428 B2
(45) Date of Patent: Jun. 19, 2012

(54) IMAGE FORMING DEVICE CAPABLE OF PREVENTING DETECTION ERROR OF TEST PATTERN ON CONVEYOR BELT

(75) Inventor: Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1084 days.

(21) Appl. No.: 11/926,884

(22) Filed: Oct. 29, 2007

(65) Prior Publication Data

US 2008/0124160 A1 May 29, 2008

(30) Foreign Application Priority Data

Nov. 29, 2006 (JP) ..... 2006-322213

(51) Int. Cl.
*G03G 15/00* (2006.01)

(52) U.S. Cl. ..... 399/397; 399/72; 399/162

(58) Field of Classification Search ..... 399/72, 399/162, 397
See application file for complete search history.

(56) References Cited

U.S. PATENT DOCUMENTS

| | | | | |
|---|---|---|---|---|
| 5,740,512 | A | 4/1998 | Hayashi et al. | |
| 6,404,450 | B1 * | 6/2002 | Fukaya | 347/116 |
| 7,399,048 | B2 * | 7/2008 | Inoue | 347/19 |

FOREIGN PATENT DOCUMENTS

| | | | |
|---|---|---|---|
| JP | 60225171 A | * | 11/1985 |
| JP | 09-175685 | | 7/1997 |
| JP | 2000-233841 | | 8/2000 |
| JP | 2005035102 A | * | 2/2005 |

OTHER PUBLICATIONS

Translation of JP 09-175685A (already submitted as Applicant's Prior Art), Samejima et al., Image Forming Device, Jul. 8, 1997.*

* cited by examiner

*Primary Examiner* — Judy Nguyen
*Assistant Examiner* — Andy Pham
(74) *Attorney, Agent, or Firm* — Banner & Witcoff, Ltd

(57) ABSTRACT

A color laser printer includes a belt conveying device having a conveyor belt for conveying a recording medium, an image forming unit that forms an image on the recording medium and a test pattern in a test-pattern area on a conveying surface of the conveyor belt, and a pressing member having a pressing surface that grows wider toward a downstream side with respect to a conveying direction in which the recording medium is conveyed and that presses the recording medium toward the conveying surface of the conveyor belt. The pressing member is disposed so that a prescribed gap is formed between the pressing surface of the pressing member and the test-pattern area on the conveying surface of the conveyor belt.

10 Claims, 7 Drawing Sheets

IMAGE FORMING DEVICE CAPABLE OF PREVENTING DETECTION ERROR OF TEST PATTERN ON CONVEYOR BELT

CROSS REFERENCE TO RELATED APPLICATION

This application claims priority from Japanese Patent Application No. 2006-322213 filed Nov. 29, 2006. The entire content of this priority application is incorporated herein by reference.

TECHNICAL FIELD

The disclosure relates to an image forming device including a belt conveying device that conveys a recording sheet, and a pressing member that presses the recording sheet against a conveyer belt of the belt conveying device.

BACKGROUND

There have been known image forming devices that include a belt conveying device and an image forming unit. The belt conveying device includes a conveyor belt for conveying a recording sheet mounted on a conveying surface thereof. The image forming unit is disposed opposing the transfer surface of the conveyor belt and forms an image on a surface of the recording sheet conveyed by the conveyor belt.

In such an image forming device, if air is trapped between the recording sheet and the conveying surface of the conveyor belt when the recording sheet is placed on the conveyor belt, the recording sheet is partially raised from the conveying surface in some cases. Such partial rising of the recording sheet adversely affects image forming operation performed by the image forming unit, causing deterioration in image quality.

In order to cope with this problem, U.S. Pat. No. 5,740,512 proposes an image forming device that has a pressing member disposed near the upstream side of a conveyor belt in a sheet conveying direction. The pressing member has a plane pressing surface whose width gradually becomes wider from the upstream side toward the downstream side in the sheet conveying direction, and a downstream end of the pressing member having the wider width always contacts the conveying surface of the conveyor belt. In this image forming device, a recording sheet conveyed to the belt conveying device is first pressed toward the conveying surface of the conveyor belt by an upstream section of the pressing surface having the narrow width, and then, gradually press-widened starting from the center in the width direction toward both widthwise ends by the pressing surface whose width grows wider toward the downstream side. As a result, air between the conveying surface of the conveyor belt and the recording sheet is pushed out to the both sides of the recording sheet. In this manner, image quality is prevented from being deteriorated due to air trapped between the conveying surface of the conveyor belt and the recording sheet.

In an image forming device, a printing test is typically performed in an initial operation time so as to confirm whether or not an adequate printing result can be obtained (e.g., whether printing position or image density is proper or not), and printing operation is adjusted based on the results of the printing test. This printing test is performed by printing a predetermined test pattern on the conveying surface of the conveyor belt and detecting the test pattern using a sensor.

SUMMARY

It is an object of the invention to provide an image forming device capable of preventing deterioration in image quality by reducing the detection error of a sensor.

In order to attain the above and other objects, the invention provides an image forming device including a feed unit, a belt conveying unit, and a pressing member. The feed unit feeds a recording medium in a first direction. The belt conveying unit includes a conveyor belt that mounts and conveys the recording medium fed by the feed unit. The conveyor belt has a conveying surface that has a test-pattern area. The image forming unit is disposed opposing the conveying surface of the conveyor belt. The image forming unit forms an image on the recording medium and a test pattern in the test-pattern area on the conveying surface of the conveyor belt. The pressing member has a pressing surface that grows wider from an upstream side toward a downstream side with respect to the first direction. The pressing surface presses the recording medium toward the conveying surface of the conveyor belt. A prescribed gap is formed between the test-pattern area of the conveying surface and the pressing surface of the pressing member, preventing the conveying surface from contacting the test-pattern area.

There is also provided an image forming device including a feed unit, a belt conveying unit, an image forming unit, and a pressing member. The feed unit feeds a recording medium in a first direction. The belt conveying unit includes a conveyor belt that mounts and conveys the recording medium fed by the feed unit. The conveyor belt has a conveying surface that has a test-pattern area. The image forming unit is disposed opposing the conveying surface of the conveyor belt. The image forming unit forms an image on the recording medium and a test pattern in the test-pattern area on the conveying surface of the conveyor belt. The pressing member has a pressing surface that grows wider from an upstream side toward a downstream side with respect to the first direction. The pressing surface presses the recording medium toward the conveying surface of the conveyor belt. The pressing member includes a sheet-shaped pressing-force reinforcing member disposed on the pressing surface at a center region with respect to a second direction orthogonal to the first direction, and the center region opposes a region of the conveying surface differing from the test-pattern area. The pressing-force reinforcing member has a surface that is smoother than the pressing surface.

BRIEF DESCRIPTION OF THE DRAWINGS

An illustrative embodiment in accordance with the invention will be described in detail with reference to the following figures wherein:

FIG. 5(*b*) is an enlarged view of a portion encircled by a line Vb in FIG. 4 from an angle slightly differing from that of FIG. 4;

DETAILED DESCRIPTION

Figure 1:
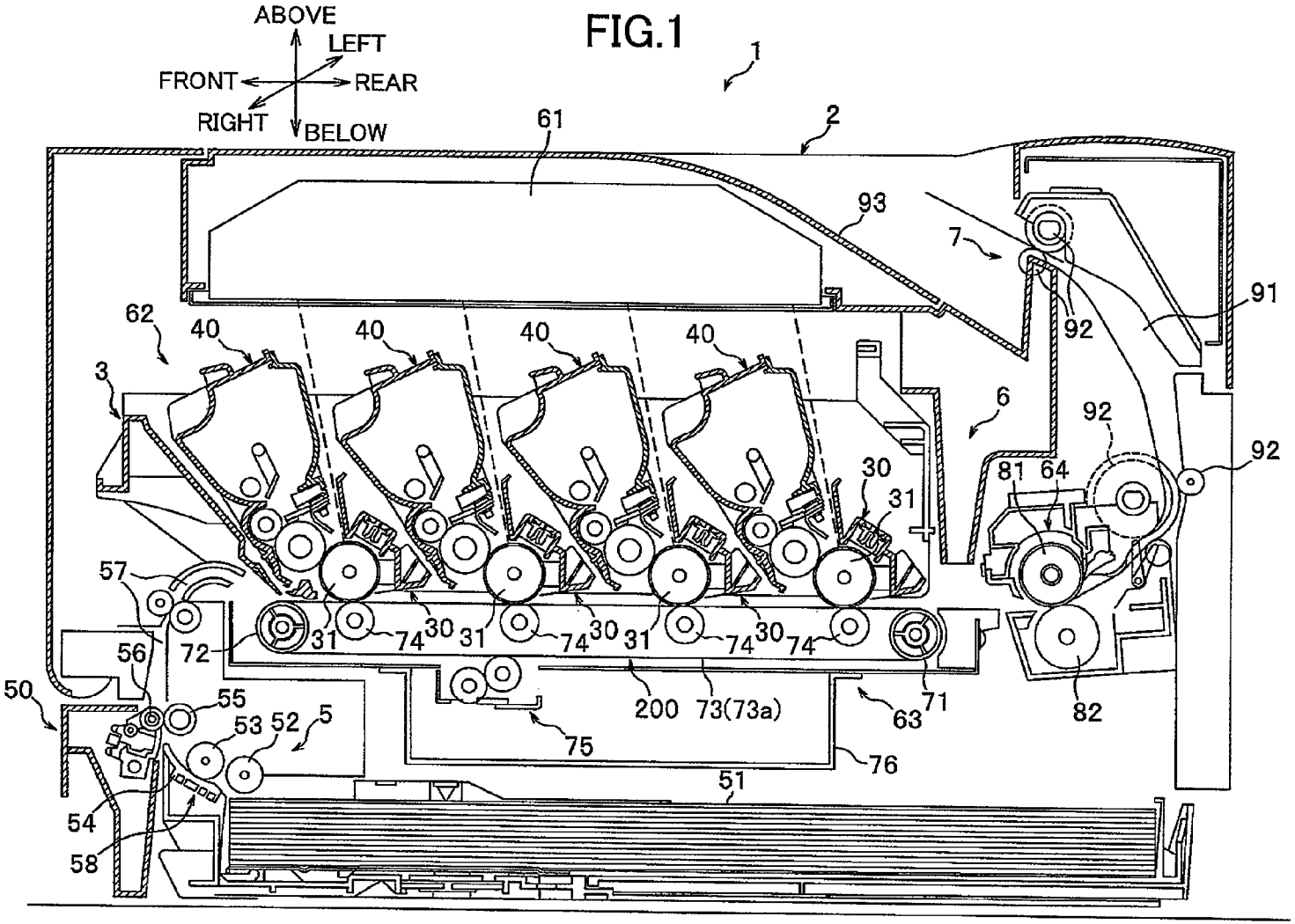
FIG. 1 is a cross-sectional view showing an overall construction of a color laser printer as an image forming device according to an embodiment of the invention.

An image forming device according to an embodiment of the invention will be described while referring to the accompanying drawings wherein like parts and components are designated by the same reference numerals to avoid duplicating description.

In this embodiment, the image forming device of the invention is applied to a color laser printer 1 shown in FIG. 1.

Note that in the following description, the expressions "front," "rear," "left," "right," "above," and "below" are used to define the various parts when the color laser printer 1 is disposed in an orientation in which it is intended to be used. Also, a width direction of the color laser printer 1 is a left-to-right direction thereof.

As shown in FIG. 1, the color laser printer 1 includes a main casing 2, and within the main casing 2, a sheet feed unit 5 for feeding a recording sheet 51 as a recording medium, an image forming unit 6 for forming images on the fed recording sheet 51, and a discharge section 7 for discharging the recording sheet 51 formed with the images. The recording sheet 51 may be a thick sheet of paper, a thin sheet of paper, a postcard, an OHP sheet, or the like.

The sheet feed unit 5 includes a sheet feed tray 50 that is detachably mounted in the bottom section of the main casing 2 and a sheet feed mechanism 58 for feeding recording sheets 51 from the sheet feed tray 50 to a conveyor belt 73 described later.

The sheet feed mechanism 58 is disposed near the front end of the sheet feed tray 50, and includes a sheet feed roller 52, a separation roller 53, a separation pad 54, a paper dust removing roller 55, and a pinch roller 56. Recording sheets 51 stack on the sheet feed tray 50 are separated and fed one sheet at a time in an upward direction through cooperative operation of the sheet feed roller 52, the separation roller 53, and the separation pad 54. As the recording sheet 51 fed in the upward direction passes between the paper dust removing roller 55 and the pinch roller 56, paper dust is removed from the recording sheet 51. Then, the recording sheet 51 is conveyed along a conveying path 57 while the conveying direction of the recording sheet 51 is changed to the rearward direction. Subsequently, the recording sheet 51 is supplied onto the conveyor belt 73.

The image forming unit 6 includes a scanner unit 61, a process unit 62, a transfer unit 63, and a fixing unit 64.

The scanner unit 61 is disposed in the upper section of the main casing 2. Although not shown in the drawings, the scanner unit 61 includes four sub-scanning units each corresponding to one of four colors cyan, magenta, yellow, and black. Each of the sub-scanning units includes a laser emitting section, a polygon mirror, a plurality of lenses, and a reflecting mirror. The laser emitting section emits a laser beam, which is scanned at a high speed by the polygon mirror in the left-to-right direction and passes through or is reflected by the plurality of lenses and the reflecting mirror so as to irradiate the surface of a corresponding photosensitive drum 31 described later.

The process unit 62 is disposed between the scanner unit 61 and the transfer unit 63, and includes a photosensitive unit 3 and a plurality of developing cartridges 40 mounted on the photosensitive unit 3.

The photosensitive unit 3 is detachably mounted in the main casing 2, and includes a plurality of (four) sub-drum units 30 juxtaposed in the horizontal direction. Each of the developing cartridges 40 accommodates toner for one of colors cyan, magenta, yellow, and black, and is attached to the corresponding one of the sub-drum units 30 at a prescribed position.

Each sub-drum unit 30 includes the photosensitive drum 31 and a Scorotron charger (not shown), and the developer cartridge 40 includes a developing roller (not shown).

In the process unit 62 having this construction, the laser beam emitted from the scanner unit 61 based on desired image data forms an electrostatic latent image on the surface of the photosensitive drum 31, and a toner image corresponding to the electrostatic latent image is formed on the surface of the photosensitive drum 31 when toner is supplied to the electrostatic latent image by the developing roller of the developing cartridge 40.

The transfer unit 63 includes a driving roller 71, a driven roller 72, the conveyor belt 73, a plurality of transfer rollers 74, and a cleaning unit 75. The driving roller 71, the driven roller 72, and the conveyor belt 73 constitute a belt conveying device 200.

The driving roller 71 and the driven roller 72 are disposed in parallel with and separated from each other. The conveyor belt 73 is an endless belt wound about the driving roller 71 and the driven roller 72. An outer surface of the conveyor belt 73 serves as a conveying surface 73*a* and contacts each of the photosensitive drums 31. The transfer rollers 74 are disposed in opposition to the corresponding photosensitive drums 31 via the conveyor belt 73, and are applied with transfer bias from a high-voltage circuit board (not shown).

During the image forming operation, the recording sheet 51 conveyed by the conveyor belt 73 is held between the photosensitive drum 31 and the transfer roller 74 via the conveyor belt 73, whereby a toner image is transferred from the photosensitive drum 31 onto the recording sheet 51.

Figure 4:
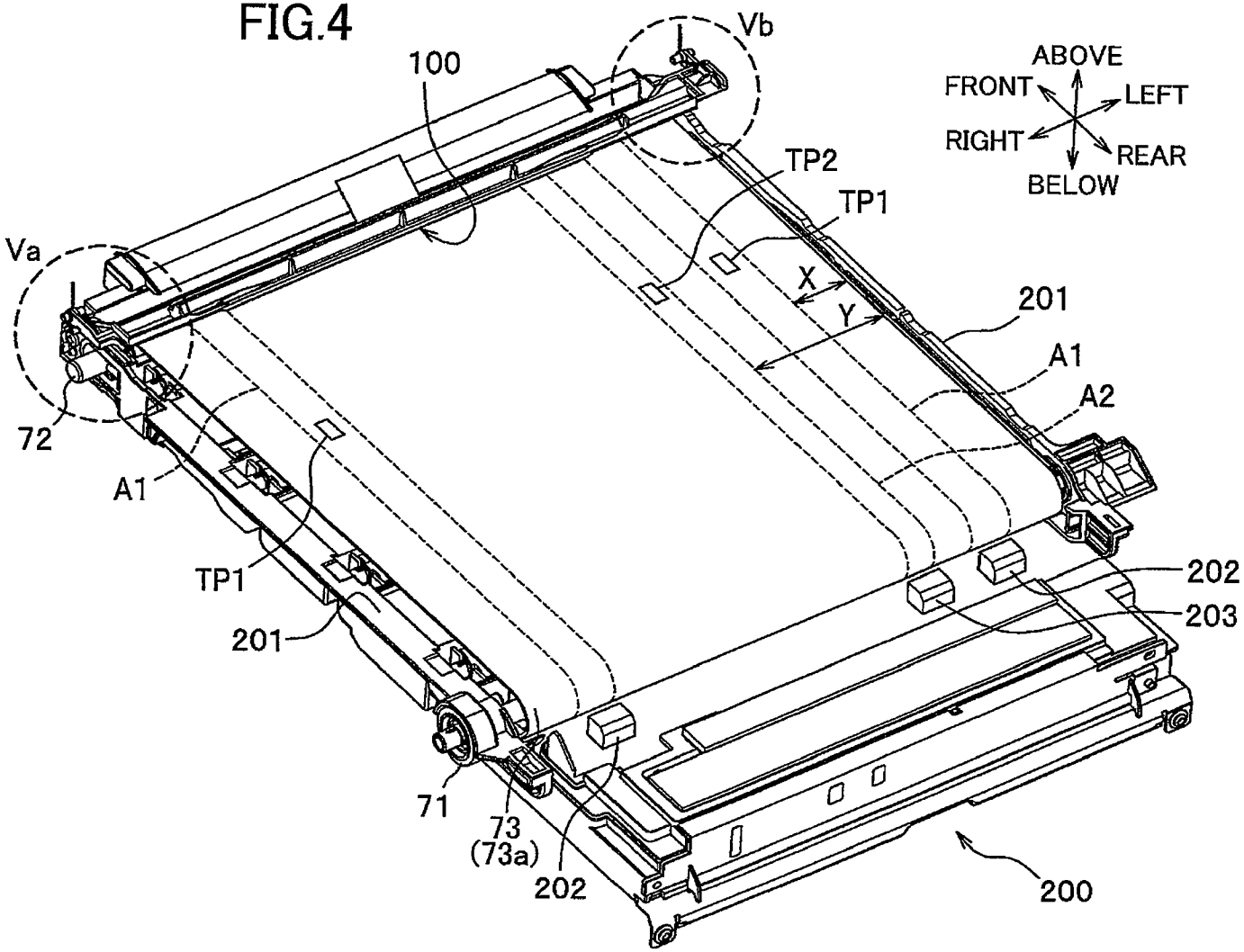
FIG. 4 is a perspective view from diagonally above of a belt conveying device of the color laser printer in FIG. 1.

Note that in a printing test for confirming the toner density or transfer position of a toner image (printing position), a toner image is transferred onto the conveyor belt 73. More specifically, as shown in FIG. 4, the conveying surface 73*a* of the conveyor belt 73 has areas A1, A1, each spaced away a distance X from the left or right edge thereof, and an area A2 spaced away a distance Y (Y>X) from the left edge thereof. A rectangular test pattern TP1 is formed in each area A1, and a rectangular test pattern TP2 is formed in the area A2.

The cleaning unit 75 is disposed below the conveyor belt 73 for removing toner adhered to the conveyor belt 73. The toner removed by the cleaning unit 75 drops into a toner accumulation section 76 disposed below the cleaning unit 75.

The fixing unit 64 is disposed inside the main casing 2 at a position downstream of the transfer unit 63 with respect to a sheet conveying direction in which the recording sheet 51 is conveyed, that is, rearward of the transfer unit 63. The fixing unit 64 includes a heating roller 81 and a pressure roller 82. The heating roller 81 accommodates a halogen lamp (no shown) for heating the surface of the heating roller 81 to a prescribed fixing temperature. The pressure roller 82 is disposed in contact with the heating roller 81 with pressure. The fixing unit 64 thermally fixes toner images onto the recording sheet 51 while the recording sheet 51 passes between the heating roller 81 and the pressure roller 82.

In the discharge section 7, a discharge-side conveying path 91 extends upward from an outlet of the fixing unit 64 and goes to the front direction. A plurality of conveying rollers 92 for conveying the recording sheet 51 is provided along the discharge-side conveying path 91. A portion of the upper surface of the main body 2 is depressed for providing a discharge tray 93. The recording sheet 51 discharged from the discharge-side conveying path 91 by the conveying rollers 92 is accumulated on the discharge tray 93.

The front side structure of the photosensitive unit 3 and the belt conveying device 200 will be described in detail.

Figure 2:
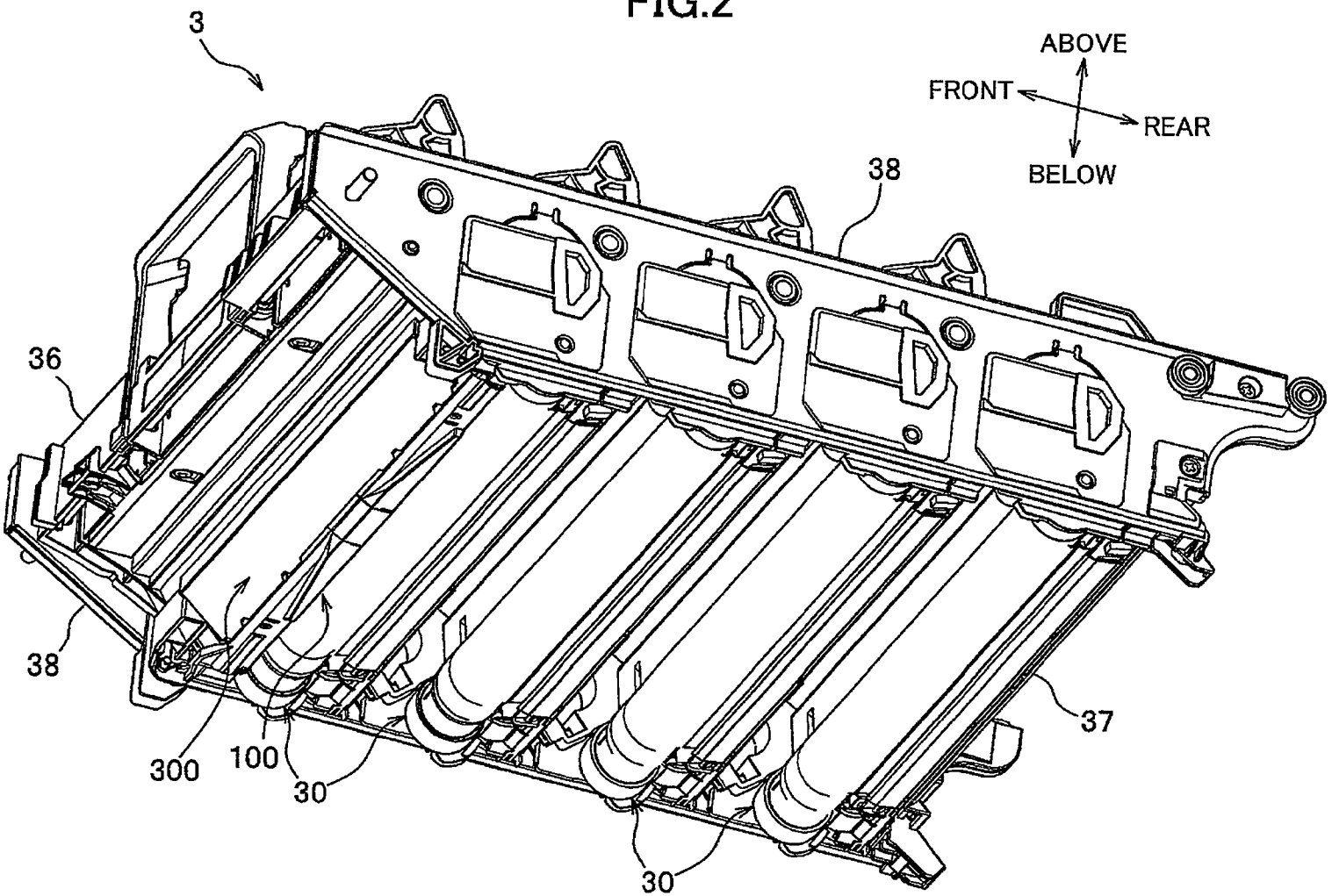
FIG. 2 is a perspective view from diagonally below of a photosensitive unit of the color laser printer in FIG. 1.

As shown in FIG. 2, the photosensitive unit 3 further includes a front beam 36, a rear beam 37, and a pair of side plates 38. A pressing member 100 is swingably supported in the side plates 38.

Figure 3:
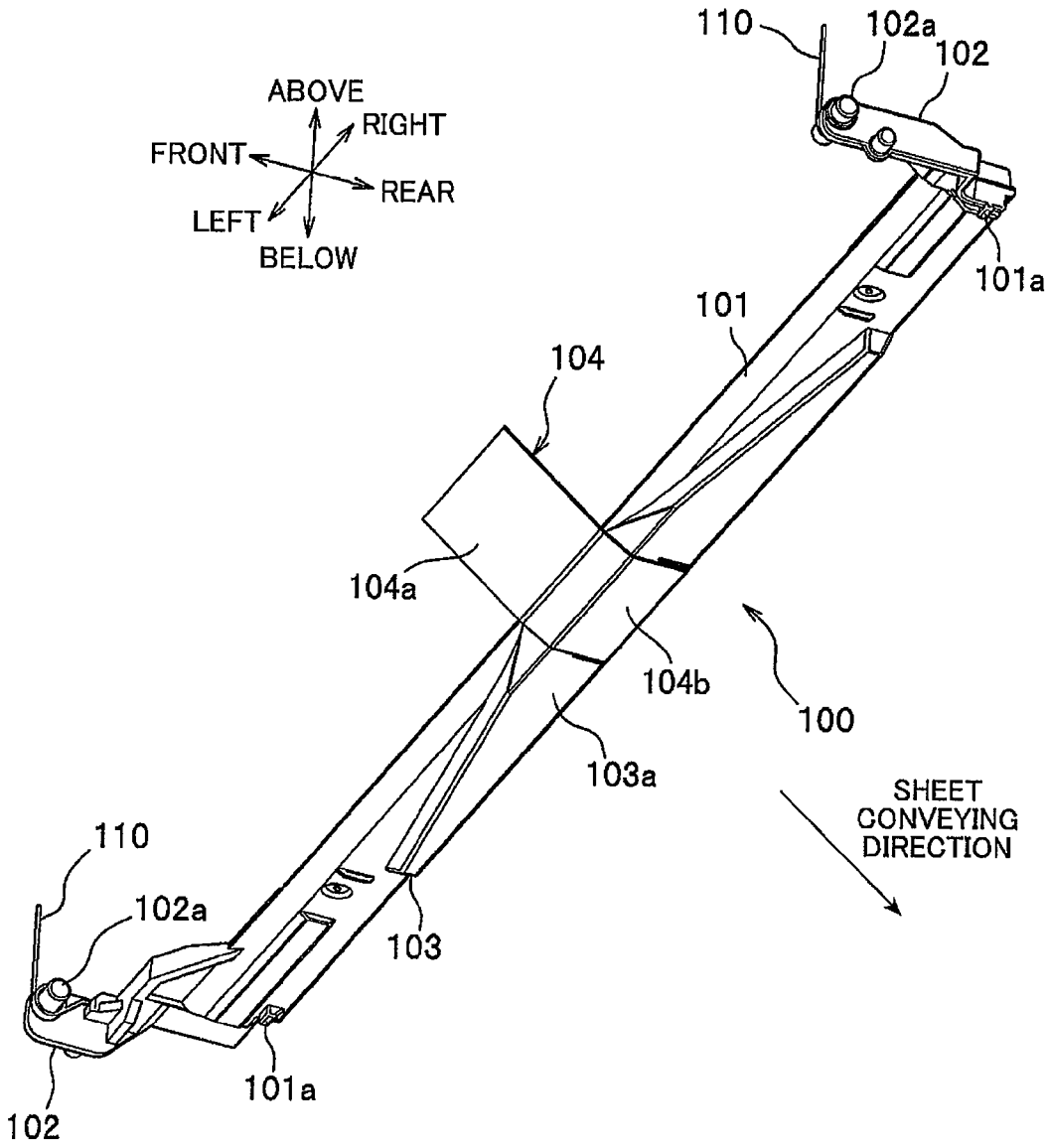
FIG. 3 is an enlarged perspective view from diagonally below of a pressing member of the color laser printer in FIG. 1.

As shown in FIG. 3, the pressing member 100 has an elongated base portion 101, arm portions 102 integrally formed with both ends of the base portion 101, a pressing portion 103 integrally formed with the center portion of the base portion 101, and a guide sheet 104 affixed to the pressing portion 103.

The base portion 101 extends in the left-to-right direction, and protrusions 101*a* and 101*a* protrude downward from both ends of the base portion 101.

The arm portions 102 extend from the both ends of the base portion 101 to the front side. A columnar supported portion 102*a* is formed at a tip end of each arm portion 102. The supported portion 102*a* is rotatably supported by the side plate 38 of the photosensitive unit 3 (FIG. 2). It should be noted that a configuration for establishing an engagement between the arm portion 102 and the side plate 38 is not especially limited. For example, a configuration in which a pin is inserted into a hole or a configuration in which a convex portion is engaged with a concave portion may be employed.

A coil-like portion at the center of a torsion spring 110 is wound around the supported portion 102*a* of the arm portion 102. One end of the torsion spring 110 is supported at an appropriate position of the arm portion 102, and the other end of the torsion spring 110 is supported at an appropriate position of the photosensitive unit 3. With this configuration, the pressing portion 103 can press down the recording sheet 51 as described later.

The pressing portion 103 protrudes downward from the center of the base portion 101. The width of the pressing portion 103 becomes wider from the upstream side toward the downstream side in the sheet conveying direction. The lower surface of the pressing portion 103 serves as a pressing surface 103*a* for pressing down the recording sheet 51. The pressing surface 103*a* is a flat surface perpendicular to the vertical direction and parallel to the conveying surface 73*a* of the conveyor belt 73.

Figure 6:
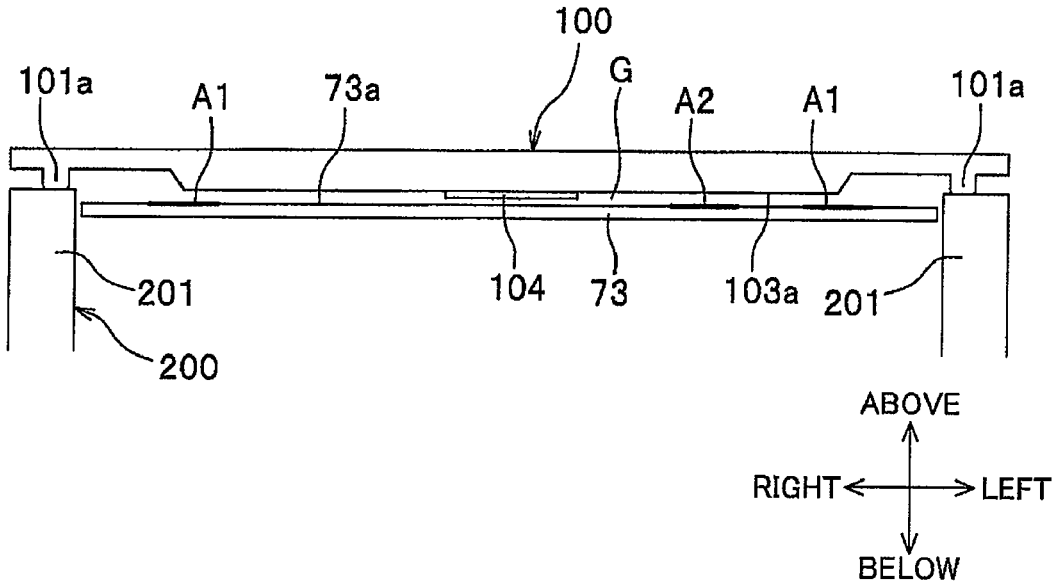
FIG. 6 is a simplified view showing the positional relationship between the pressing member and a conveyor belt of the belt conveying device.
Figure 7:
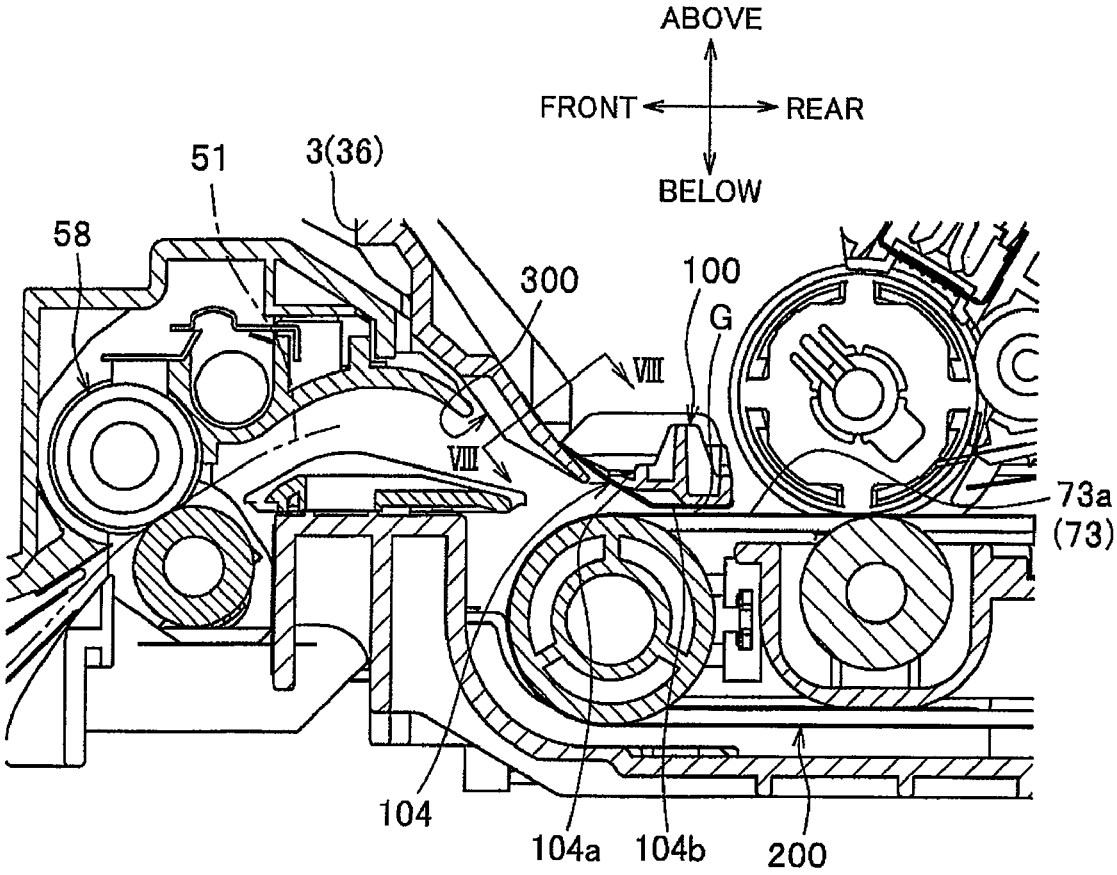
FIG. 7 is a cross-sectional view showing the construction around the pressing member.

The guide sheet 104 is a rectangular sheet made of resin, and one end portion of the upper surface thereof (downstream portion 104*b*) is affixed to the center of the pressing surface 103*a* such that, as shown in FIG. 6, the guide sheet 104 is disposed at a position that does not face the areas A1 and A2 (a position displaced from the areas A1 and A2 as viewed from the above) on the conveyer surface 73*a* of the conveyer belt 73. Further, as shown in FIG. 3, the other end portion of the guide sheet 104 protrudes beyond the base portion 101 to the front. The portion of the guide sheet 104 protruding beyond the base portion 101 is supported by the photosensitive unit 3 as to become a slant surface 104*a* that is inclined upward toward the front, as shown in FIG. 7. The lower surface of the guide sheet 104 is formed smoother (have a smaller surface roughness) than the pressing surface 103*a*. In other words, the dynamic friction coefficient of the lower surface of the guide sheet 104 with respect to the recording sheet 51 is smaller than that of the pressing surface 103*a*.

As shown in FIG. 4, the belt conveying device 200 has two side frames 201, two displacement detection sensors 202, and a density detection sensor 203 in addition to the drive roller 71, the driven roller 72, and the conveyor belt 73 described above.

The side frames 201 are provided one on either left or right side of the conveyer belt 73 and support the conveyor belt 73 through the drive roller 71 and the driven roller 72.

The displacement detection sensors 202 are for detecting the positions of the test patterns TP1 formed on the areas A1, A1 of the conveyor belt 73. A light reflection type sensor having a light-emitting element and a light-sensitive element can be used as the displacement detection sensor 202, for example.

The density detection sensor 203 is for detecting the density of the rectangular test pattern TP2 formed on the area A2 of the conveyor belt 73. A light reflection type sensor having a light-emitting element and a light-sensitive element can be used as the density detection sensor 203, for example.

Figure 5A:
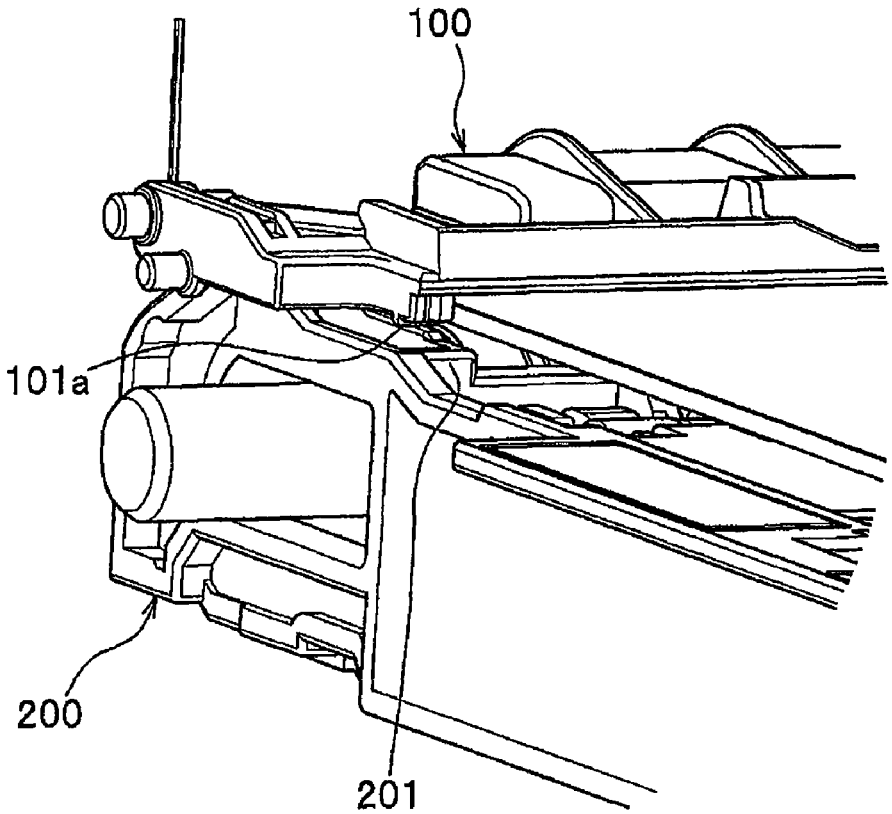
FIG. 5(*a*) is an enlarged view of a portion encircled by a line Va in FIG. 4 from an angle slightly differing from that of FIG. 4.
Figure 5B:
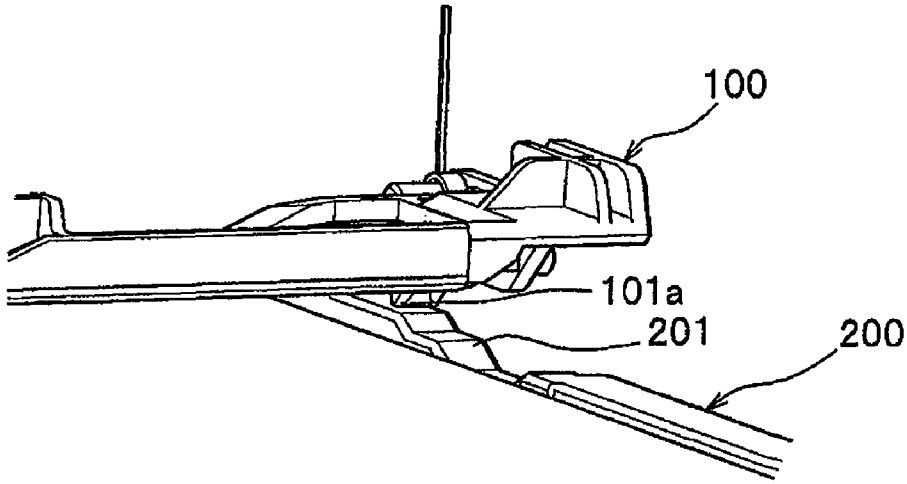

The pressing member 100 is disposed at the front end of the belt conveying device 200. More specifically, as shown in FIGS. 5(*a*) and 5(*b*), the pressing member 100 is disposed such that the left and right protrusions 101*a* contact the upper surfaces of the corresponding side frames 201 of the belt conveying device 200. With this configuration, as shown in FIG. 6, a narrow gap G (having a vertical size of 0.5 mm) is formed between the pressing surface 103*a* of the pressing member 100 and the conveying surface 73*a* of the conveyor belt 73. The size of the gap G is slightly larger than the thickness (0.25 mm) of the guide sheet 104. Accordingly, the guide sheet 104 is slightly spaced away from the conveying surface 73*a* of the conveyor belt 73.

Since the protrusions 101*a* for forming the gap G between the pressing surface 103*a* and the conveying surface 73*a* contact the side frames 201 of the belt conveying device 200, the durability of the conveyor belt 73 and the protrusions 101*a* can be increased as compared to a case where the gap G is formed by bringing the protrusions 101*a* into contact with the conveyor belt 73.

As shown in FIG. 7, a guide portion 300 is formed between the pressing member 100 and the paper supply mechanism 58 as a part of the front beam 36 of the photosensitive unit 3 (FIG. 2). The guide portion 300 is for guiding the recording sheet 51 to a position between the pressing member 100 and the conveying surface 73*a* of the conveyor belt 73

Figure 8:
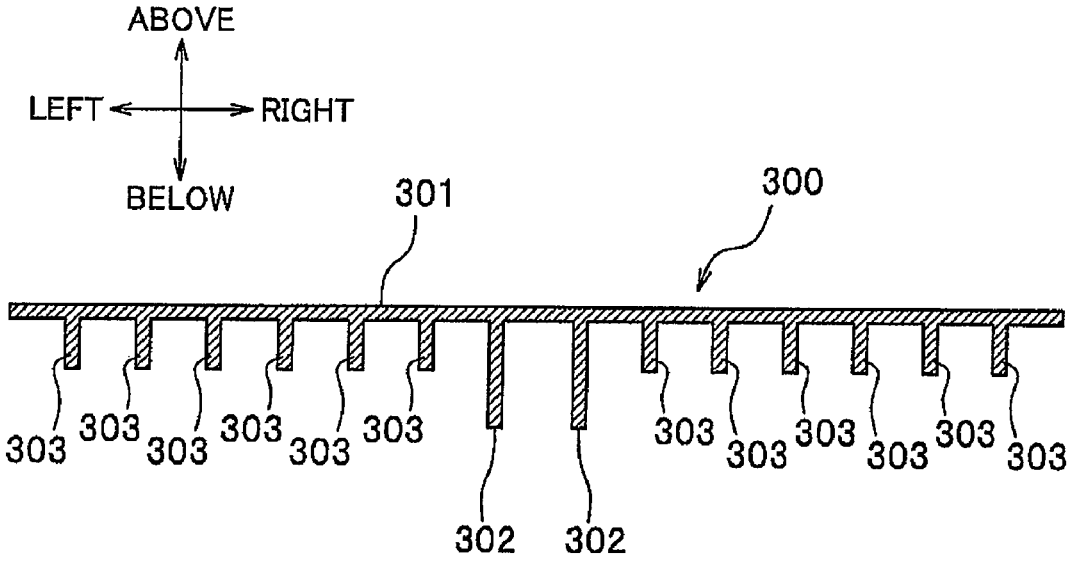
FIG. 8 is a cross-sectional view taken along a line VIII-VIII in FIG. 7

As shown in FIG. 8, the guide portion 300 has a base portion 301 extending in the left-to-right direction, two center ribs 302 protruding downward from the center of the base portion 301, and a plurality of outer ribs 303 protruding downward from the left and right portions of the base portion 301. Each of the center ribs 302 has a height greater than the height of the outer ribs 303.

Next, operation of the guide portion 300 and the pressing member 100 will be described.

As shown in FIG. 7, the recording sheet 51 conveyed from the paper supply mechanism 58 to the belt conveying device 200 is first guided to the lower side by the guide portion 300. At this time, since the center ribs 302 are formed higher than the outer ribs 303, the recording sheet 51 is supplied to the belt conveying device 200 with the widthwise center thereof protruding downward (to the conveyor belt 73 side).

After passing by the guide portion 300, the recording sheet 51 tends to move upward (in the direction away from the conveyor belt 73). However, the slant surface 104*a* of the guide sheet 104 guides the recording sheet 51 toward the conveyor belt 73. In this manner, it is possible to reliably guide the recording sheet 51 toward the conveyor belt 73. That is, the recording sheet 51 is smoothly guided to the narrow gap G between the pressing surface 103*a* and the conveying surface 73*a* by the slant surface 104*a* of the guide sheet 104.

Upon entering the gap G, the recording sheet 51 is pressed toward the conveying surface 73*a* by the downstream portion 104*b* of the guide sheet 104. Thereafter, the recording sheet 51 is gradually press-widened starting from the widthwise center to the widthwise sides by the pressing surface 103*a* whose width is gradually increased toward the downstream side in the sheet conveying direction. As a result, the air between the conveying surface 73*a* and the recording sheet 51 is pushed to the both sides of the recording sheet 51.

As described above, according to the present embodiment, since the width of the pressing surface 103*a* of the pressing member 100 increases toward the downstream side in the sheet conveying direction, it is possible to suppress deterioration in image quality caused due to air trapped between the recording sheet 51 and the conveying surface 73*a*.

Also, since the guide sheet 104 protrudes from the pressing surface 103*a* by the amount corresponding to the thickness of the guide sheet 104, the widthwise center of the recording sheet 51 is pressed toward the conveying surface 73*a* more reliably. In other words, the guide sheet 104 serves to reinforce the pressing force against the recording sheet 51 by the amount corresponding to the thickness of the guide sheet 104. Hence, it is possible to prevent image quality from being deteriorated due to the air trapped between the recording sheet 51 and the conveying surface 73*a*.

Further, the guide portion 300 guides the recording sheet 51 to curve so that the widthwise center of the recording sheet 51 protrudes downward. Thus, the widthwise center of the recording sheet 51 is pressed against the conveying surface 73*a* of the conveyor belt 73 more reliably, thereby suppressing deterioration in image quality.

Since the lower surface of the guide sheet 104 is smoother than the pressing surface 103*a*, the guide sheet 104 does not act as a resistance to the conveyance of the recording sheet 51, achieving smooth conveyance of the recording sheet 51.

Next, a relationship between the areas A1 and A2 of the conveyor belt 73 and the pressing surface 103 of the pressing member 100 will be described.

As shown in FIG. 4, the test patterns TP1 and TP2 are printed on the corresponding areas A1 and A2 of the conveyor belt 73 while the conveyer belt 73 is being conveyed, and then conveyed toward the displacement detection sensors 202 and the density detection sensor 203. The positions of the test patterns TP1 are detected by the corresponding displacement detection sensors 202, and density of the test pattern TP2 is detected by the density detection sensor 203. After the detection, the test patterns TP1 and TP2 are further conveyed and removed from the conveyor belt 73 by the cleaning unit 75 (see FIG. 1).

Here, if the pressing surface 103*a* of the pressing member 100 always contacts the conveying surface 73*a* as in the image forming device disclosed in U.S. Pat. No. 5,740,512 described above, the surface condition of the conveying surface 103*a* deteriorates. When the test patterns TP1 and TP2 are formed on the deteriorated conveying surface 73*a*, a detection error may occur in the sensors 202 and 203. If such detection error occurs, image forming operation is not accurately adjusted, resulting in deterioration in image quality.

However, in the present embodiment, the gap G is maintained between the pressing surface 103*a* and the conveying surface 73*a* (areas A1 and A2) as shown in FIG. 6, preventing the areas A1 and A2 from being scraped and damaged by contacting the pressing surface 103*a*. Accordingly, during the printing tests, the test patterns TP1 and TP2 are satisfactorily formed and detected by the corresponding sensors 202 and 203, preventing the detection errors. As a result, image forming operation can accurately be adjusted to thereby prevent deterioration in image quality.

Further, if the pressing surface 103*a* bends downward, the guide sheet 104 affixed to the pressing surface 103*a* is brought into contact with the center portion of the conveying surface 73*a*. This ensures a gap corresponding to the thickness of the guide sheet 104 between the pressing surface 103*a* and the areas A1, A2, thereby preventing the areas A1 and A2 from being damaged by the pressing surface 103*a*.

While the invention has been described in detail with reference to the above embodiment thereof, it would be apparent to those skilled in the art that various changes and modifications may be made therein without departing from the spirit of the invention.

For example, the pressing surface 103*a* is a plane surface in the above embodiment. However, the invention is not limited to this configuration. For example, the pressing surface 103*a* may be a curved surface whose widthwise center portion protrudes toward the conveyor belt 73. In this case, the widthwise end portions of the pressing surface 103*a* are further apart from the areas A1 and A2, thereby ensuring the gap between the pressing surface 103*a* and the areas A1, A2 more reliably. Further, if the recording sheet 51 has wrinkles, the wrinkles can be smoothened outward from the center of the recording sheet 51 by the curved pressing surface 103*a*.

In the above-described embodiment, the gap G is formed by providing the protrusions 101*a* in the pressing member 100. However, the invention is not limited to this configuration. For example, the gap G may be formed by proving protrusions that protrude upward from the side frames 201 of the belt conveying device 200 so as to support the pressing member 100. Alternatively, the guide sheet 104 affixed to the pressing surface 103*a* may be configured to slidably contact the conveyor belt 73 to form the gap G corresponding to the thickness of the guide sheet 104 between the contact surface 103*a* and the areas A1 and A2, without providing the protrusions 101*a* on the pressing member 100.

In the above-described embodiment, the guide sheet 104 serves as a protruding member or pressing force reinforcing member that is provided in the center of the pressing surface 103*a*. However, the invention is not limited to this configuration. For example, a protruding member may be formed integrally with the pressing surface 103*a*.

In the above embodiment, the invention is applied to the color laser printer 1. However, the invention is also applicable to other image forming devices, such as photocopiers or multifunction devices.

What is claimed is:

1. An image forming device comprising:

a feed unit configured to feed a recording medium in a first direction;

a belt conveying unit including a conveyor belt configured to mount and convey the recording medium fed by the feed unit, the conveyor belt having a conveying surface that has a test-pattern area, the conveying surface having a pair of side areas that are located in both side sections of the conveying surface in a second direction orthogonal to the first direction, the conveying surface having a center area that is located between the pair of side areas, an entire part of the test-pattern area being located in the pair of side areas and no part of the test-pattern area being located in the center area;

an image forming unit that is disposed opposing the conveying surface of the conveyor belt, the image forming unit configured to form an image on the recording medium and a test pattern in the test-pattern area on the conveying surface of the conveyor belt; and a pressing member having a pressing surface that grows wider from an upstream side toward a downstream side with respect to the first direction, the pressing surface configured to press the recording medium toward the conveying surface of the conveyor belt, wherein a prescribed gap is formed between the test-pattern area of the conveying surface and the pressing surface of the pressing member, preventing the pressing surface from contacting the test-pattern area, wherein the pressing member has a protruding member that protrudes toward the conveying surface from a center position of the pressing surface in the second direction, the protruding member confronting an area of the conveying surface other than the test-pattern areas, wherein the pressing member is formed with a protrusion that directly contacts a part of the belt conveying unit other than the test-pattern area, wherein the belt conveying unit further includes a frame that supports the conveyor belt, the protrusion directly contacting the frame, thereby forming a gap between the protruding member and the conveying surface of the conveyor belt when no recording medium exists between the protruding member and the conveying member.

2. The image forming device according to claim 1, wherein a guide part is integrally formed with the protruding member at an upstream end with respect to the first direction, the guide part guiding the recording medium toward the conveyor belt.

3. The image forming device according to claim 1, wherein the protruding member has a surface that is smoother than the pressing surface.

4. The image forming device according to claim 1, wherein the pressing surface of the pressing member curves such that a center portion of the pressing surface with respect to the second direction protrudes toward the conveyor belt.

5. The image forming device according to claim 1, further comprising a guide member disposed downstream of the feed unit with respect to the first direction, the guide member configured to guide the recording medium toward a position between the pressing member and the conveying surface of the conveyor belt while bending the recording medium such that a center of the recording medium with respect to the second direction protrudes toward the conveyor belt.

6. The image forming device according to claim 1, further comprising a sensor that detects the test pattern formed in the test-pattern area.

7. The image forming device according to claim 1, wherein the pressing member is swingably supported on the image forming unit.

8. An image forming device comprising:

a feed unit configured to feed a recording medium in a first direction;

a belt conveying unit including a conveyor belt configured to mount and convey the recording medium fed by the feed unit, the conveyor belt having a conveying surface that has a test-pattern area the conveying surface having a pair of side areas that are located in both side sections of the conveying surface in a second direction orthogonal to the first direction, the conveying surface having a center area that is located between the pair of side areas, an entire part of the test-pattern area being located in the pair of side areas and no part of the test-pattern area being located in the center area;

an image forming unit that is disposed opposing the conveying surface of the conveyor belt, the image forming unit configured to form an image on the recording medium and a test pattern in the test-pattern area on the conveying surface of the conveyor belt; and a pressing member having a pressing surface that grows wider from an upstream side toward a downstream side with respect to the first direction, the pressing surface configured to press the recording medium toward the conveying surface of the conveyor belt, wherein the pressing member includes a sheet-shaped pressing-force reinforcing member disposed on the pressing surface at a center region with respect to the second direction, the center region opposing the center area of the conveying surface, the pressing-force reinforcing member having a surface that is smoother than the pressing surface, wherein the pressing member is formed with a protrusion that directly contacts a part of the belt conveying unit other than the test-pattern area, wherein the belt conveying unit further includes a frame that supports the conveyor belt, the protrusion directly contacting the frame, thereby forming a gap between the sheet-shaped pressing-force reinforcing member and the conveying surface of the conveyor belt when no recording medium exists between the sheet-shaped pressing-force reinforcing member and the conveying surface.

9. The image forming device according to claim 8, wherein a prescribed gap is formed between the pressing surface and the test-pattern area on the conveying surface.

10. The image forming device according to claim 8, further comprising a biasing member configured to bias the pressing member toward the conveyor belt.

* * * * *